United States Patent [19]

Vanderhulst

[11] 4,307,637

[45] Dec. 29, 1981

[54] METHOD FOR ADJUSTMENT OF SLITTER BLADES

[75] Inventor: Remmelt Vanderhulst, Krommenie, Netherlands

[73] Assignee: S&S Corrugated Paper Machinery Co., Inc., Brooklyn, N.Y.

[21] Appl. No.: 157,407

[22] Filed: Jun. 9, 1980

[51] Int. Cl.[3] ..... B26D 1/24

[52] U.S. Cl. ..... 83/13; 83/498; 83/500

[58] Field of Search ..... 83/498–504, 83/507, 13

[56] References Cited

U.S. PATENT DOCUMENTS 3,312,135 4/1967 Mraz ..... 83/500 X 3,685,379 8/1972 Frye et al. ..... 83/502 X

*Primary Examiner*—Frank T. Yost

*Attorney, Agent, or Firm*—Ostrolenk, Faber, Gerb & Soffen

[57] ABSTRACT

A pair of cooperating circular slitter blades are adjusted by locking a first of these blades in a selected axial position on its drive shaft and moving the second of these blades along its drive shaft into engagement with the first blade. Prior to locking the second blade in an axial position on its drive shaft, the latter together with the second blade are turned slowly through at least one revolution for axial runout of the second blade. Thereafter the second blade is locked in axial position.

2 Claims, 4 Drawing Figures

FIG. 1
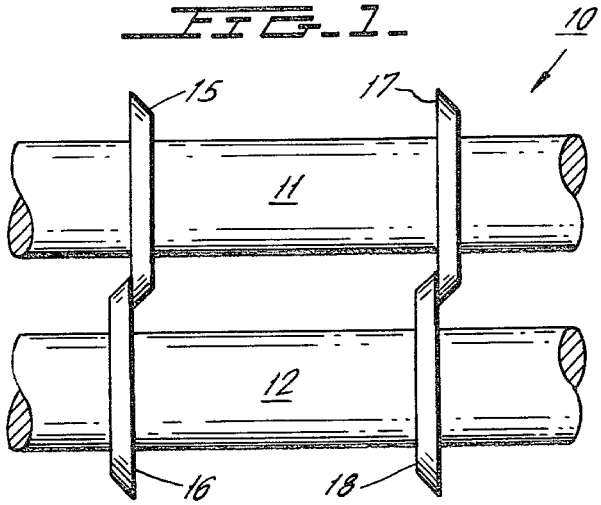
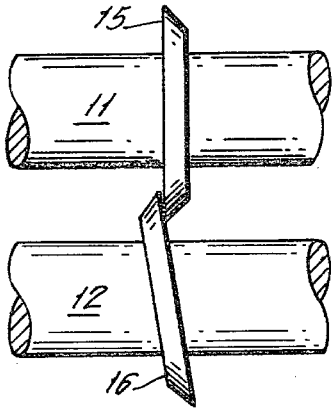
FIG. 2
(PRIOR ART)
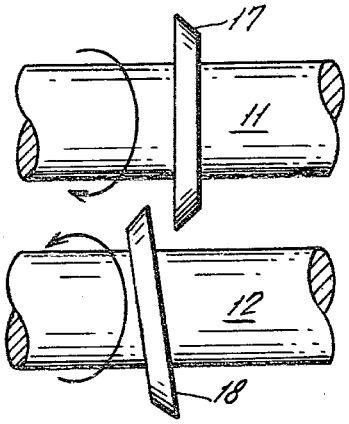
FIG. 3
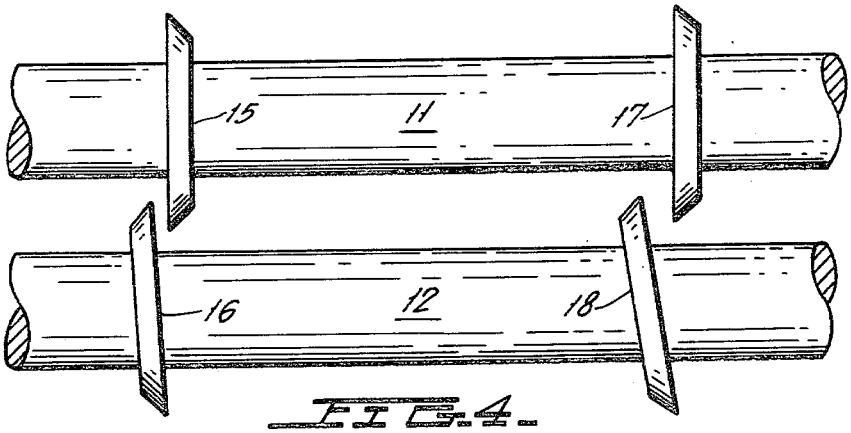
FIG. 4

METHOD FOR ADJUSTMENT OF SLITTER BLADES

This invention relates to rotary slitters in general and more particularly relates to a method for setting the operative relationship between cooperating circular slitting blades.

Shortly after a relatively wide web of corrugated board issues from a so-called double backer, the wide web is slit longitudinally into a plurality of narrower webs. Typically, each of the longitudinal cuts or slits is made by a pair of cooperating rotating slitter blades which must be set with precision in order to obtain an accurate cut and to prevent excessive wearing of the slitter blades.

In the prior art, positioning of the slitter blades was usually accomplished by accurately positioning one of the blades and locking it in adjusted position. Thereafter, the other blade was brought into engagement with the fixed blade and then the other blade was locked in axial position. Even though the contact pressure between the blades was not particularly great for the angular positions of the blades at the time the last of these blades was locked in axial position, as the blades rotated excessive forces developed between the blades leading to excessive blade wear. More particularly, high contact forces resulted from so-called axial runout, a condition which exists because some points of the engaging blade surfaces lie outside of a single plane of engagement lying perpendicular to the shafts for the slitter blades.

In order to eliminate excessive wear due to axial runout, the prior art has provided means for axially biasing one of the slitter blades toward the other cooperating slitter blade. This type of arrangement is disclosed in U.S. Pat. No. 4,026,176 issued May 31, 1977 to G. Weiskopf for Means For Setting Slitting Heads. In order to be effective, the springs of the prior art arrangement must exert sufficient force so that the blade being biased is not easily deflected yet the force must not be so great that there is excessive blade wear.

In order to overcome the aforesaid difficulty encountered by the prior art, the instant invention provides an arrangement wherein both of the cooperating slitter blades are locked in fixed positions on their respective shafts. However, because of a novel set-up method, blade wear is reduced substantially over that resulting from prior art arrangements. In particular, according to the instant invention the first slitter blade of the pair is locked in a selected axial position, the second slitter blade is moved axially into engagement with the first slitter blade, both shafts are then rotated slowly, and then the second slitter blade is locked in axial position. With this set-up arrangement, the blades make only line-to-line contact at the point of closest approach between the blades. Axial runout causes only a small clearance between the blades. Typically, such clearance is in the order of 0.003" which, in the case of sharp blades, will cause no problems in cutting. Since there is no negative clearance or interference between blades, excessive blade wear is avoided.

Accordingly, the primary object of the instant invention is to provide a novel method for setting the operative relationship between rotating slitter blades.

Another object is to provide a method of this type which results in substantially reduced blade wear.

A further object is to provide a method of this type which is utilized with cooperating slitter blades, both of which are locked in axially fixed positions.

These objects as well as other objects of this invention shall become readily apparent after reading the following description of the accompanying drawings in which:

FIG. 1 is a side elevation of two sets of slitter blades on a common set of shafts during an intermediate step in the set-up process according to the instant invention.

FIG. 2 is a side elevation of one set of slitter blades showing the effect of axial runout according to prior art set-up methods.

FIG. 3 is a side elevation of a set of slitter blades showing the effect of axial runout according to the method of the instant invention.

FIG. 4 is a side elevation illustrating two sets of cooperating slitter blades on a common set of shafts, with the operating relationships between the blades of each set having been set up utilizing the method of the instant invention.

Now referring to the Figures and more particularly to FIG. 1 which illustrates slitter 10 for longitudinally cutting a web of corrugated board (not shown) or the like which moves between and parallel to slitter shafts 11, 12 in a plane perpendicular to the plane of the drawings. Cooperating circular slitter knives 15, 16 are mounted on respective shafts 11, 12 as are knives 17, 18 of another set of cooperating slitter knives. According to the prior art, slitter knives 15–18 are moved to and locked in their respective cutting positions by initially moving blades 15 and 17 to selected axial positions where they are locked against axial movement. Thereafter, blade 16 is moved axially along shaft 12 until blade 16 engages blade 15 and then blade 16 is locked in axial position. Similarly, blade 18 is moved axially along shaft 12 until blade 18 engages blade 17 after which blade 18 is locked in axial position. Utilizing the aforesaid set-up procedure of the prior art, axial runout, as shown in FIG. 2, results in extremely high forces acting between blades 15, 16 leading to excessive blade wear. Axial runout comes about because the engaging blade surfaces are not parallel to one another for all rotational positions of shafts 11, 12.

Pursuant to the instant invention, blade set up takes place by initially moving one of the blades in each set, say blade 17, to a selected axial position along upper shaft 12 and then locking blade 17 in this position. Blade 18 is then moved axially along shaft 12 into engagement with locked blade 17. Prior to locking blade 18 in axial position, shafts 11, 12, and blades 17, 18 keyed thereto are rotated slowly through at least one complete revolution. Now the axial runout of blade 18 causes the latter to be realigned and assume the position shown in FIG. 3. This results in only line-to-line contact between blades 17, 18 at the point of closest approach between them. This runout causes only a small positive clearance between blades 17, 18. With sharp blades 17, 18, as much as 0.003" of clearance causes no problems in cutting, and without negative clearance or interference, excessive loading between blades 17, 18 is avoided. After runout, blade 18 is locked in axial position.

In FIG. 4 both of the blades 16, 18 on lower shaft 12 have, according to the instant invention, been locked in their respective axial positions after axial runout. Preferably, to obtain the arrangement of FIG. 4 both of the blades 15, 17 are locked in their respective axial positions on upper shaft 11. Blades 16 and 18 are then moved axially on shaft 12 into contact with the respective blades 15 and 17. However, prior to locking blades 16 and 18 in these axial positions both shafts 11 and 12 are rotated slowly to rotate blades 15–18 through at least one complete revolution whereby blades 16 and 18 assume runout positions in which they are locked axially to shaft 12.

It is noted that for purposes of illustration only, the proportions between the slitter blades and their shafts is not accurate. That is, these proportions have been exaggerated in order to accentuate the condition resulting from axial runout.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A method for setting the operative relationship between cooperating first and second circular slitting blades mounted on respective first and second parallel rotatable shafts; said method comprising the steps of locking the first blade in a selected operative axial position on the first shaft and moving the second blade into operative side-to-side engagement with the first blade; thereafter, and prior to locking said second blade in axial position on said second shaft, rotating said shafts and blades thereon slowly through at least one revolution; and thereafter locking said second blade in the axial runout position assumed by said second blade on said second shaft resulting from the aforesaid step of rotating said shafts slowly through at least one revolution.

2. A method as set forth in claim 1 in which there is a third slitting blade which is locked in a selected operative axial position on the first shaft and a fourth slitting blade on said second shaft which is moved into operative side-to-side engagement with said third blade; thereafter, and prior to locking said second and fourth blades in operative positions on said second shaft; rotating said shafts and blades thereon slowly through at least one revolution; and thereafter locking said fourth blade in the axial runout position assumed by said fourth blade on said second shaft resulting from the aforesaid step of rotating said shafts slowly through at least one revolution.

* * * * *